US011874008B2

(12) United States Patent
Dempsey et al.

(10) Patent No.: US 11,874,008 B2
(45) Date of Patent: Jan. 16, 2024

(54) HVAC SYSTEM DISCOMFORT INDEX AND DISPLAY

(71) Applicant: CARRIER CORPORATION, Palm Beach Gardens, FL (US)

(72) Inventors: Daniel J. Dempsey, Carmel, IN (US); Xinyu Wu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 326 days.

(21) Appl. No.: 16/752,860

(22) Filed: Jan. 27, 2020

(65) Prior Publication Data

US 2020/0271345 A1 Aug. 27, 2020

(30) Foreign Application Priority Data

Feb. 25, 2019 (CN) ..... 201910137094.X

(51) Int. Cl.

| | |
|---|---|
| ***F24F 11/38*** | (2018.01) |
| ***F24F 11/63*** | (2018.01) |
| ***F24F 11/526*** | (2018.01) |
| *F24F 110/12* | (2018.01) |

(52) U.S. Cl.

CPC ..... *F24F 11/38* (2018.01); *F24F 11/526* (2018.01); *F24F 11/63* (2018.01); *F24F 2110/12* (2018.01)

(58) Field of Classification Search

None

See application file for complete search history.

(56) References Cited

U.S. PATENT DOCUMENTS

| | | | |
|---|---|---|---|
| 6,225,907 | B1 | 5/2001 | Derryberry et al. |
| 7,032,397 | B1 | 4/2006 | Mueller et al. |
| 7,135,965 | B2 | 11/2006 | Chapman, Jr. et al. |
| 7,216,016 | B2 | 5/2007 | Van Ostrand et al. |
| 7,225,054 | B2 | 5/2007 | Amundson et al. |
| 7,308,384 | B2 | 12/2007 | Shah et al. |
| 8,170,835 | B2 | 5/2012 | Smith et al. |
| 8,606,554 | B2 | 12/2013 | Zimmermann et al. |

(Continued)

FOREIGN PATENT DOCUMENTS

| | | | |
|---|---|---|---|
| CN | 101788395 | A | 7/2010 |
| CN | 102884486 | A | 1/2013 |

(Continued)

OTHER PUBLICATIONS

Chinese Office Action for application CN 20191013794.X, dated Sep. 27, 2022, 6 pages.

*Primary Examiner* — Santosh R Poudel

(74) *Attorney, Agent, or Firm* — CANTOR COLBURN LLP

(57) ABSTRACT

A system and method for controlling a heating, ventilation, and air-conditioning (HVAC) system is provided. Aspects include receiving, from a sensor, operational data associated with the HVAC system, receiving, from the sensor, environmental data associated with the HVAC system, analyzing the operational data and the environmental data to determine a potential comfort issue with the HVAC system, receiving a discomfort index associated with the HVAC system, plotting an indicia on the discomfort index based on the operational data and the environmental data, and determining a root cause of the potential comfort issue based at least in part on a coordinate of the indicia on the discomfort index.

20 Claims, 4 Drawing Sheets

(56) References Cited

U.S. PATENT DOCUMENTS

| | | | | |
|---|---|---|---|---|
| 8,689,140 | B2 | 4/2014 | Horiuchi et al. | |
| 8,713,697 | B2 | 4/2014 | Courtney et al. | |
| 8,876,013 | B2 | 11/2014 | Amundson et al. | |
| 9,002,523 | B2 | 4/2015 | Erickson et al. | |
| 9,024,765 | B2 | 5/2015 | Hoesl | |
| 9,206,993 | B2 | 12/2015 | Barton et al. | |
| 9,551,495 | B2 | 1/2017 | Abiprojo | |
| 9,595,070 | B2 | 3/2017 | Matsuoka et al. | |
| 9,645,589 | B2 | 5/2017 | Leen et al. | |
| 9,765,979 | B2 | 9/2017 | Alsaleem et al. | |
| 9,977,409 | B2 | 5/2018 | Giering et al. | |
| 9,989,960 | B2 | 6/2018 | Wacker | |
| 2003/0070438 | A1* | 4/2003 | Kikuchi | G06Q 50/06 62/141 |
| 2008/0315000 | A1* | 12/2008 | Gorthala | G05D 22/02 236/94 |
| 2011/0153090 | A1* | 6/2011 | Besore | G05B 15/02 700/278 |
| 2013/0197698 | A1 | 8/2013 | Shah et al. | |
| 2015/0194912 | A1* | 7/2015 | Sugisaki | F25B 49/025 318/490 |
| 2016/0018123 | A1* | 1/2016 | Yabunouchi | F24F 11/64 700/278 |
| 2017/0023934 | A1* | 1/2017 | Dempsey | F24F 5/0046 |
| 2017/0074537 | A1 | 3/2017 | Bentz et al. | |
| 2017/0286204 | A1* | 10/2017 | Dibowski | G06F 11/0772 |
| 2017/0352245 | A1 | 12/2017 | Maher et al. | |
| 2018/0068034 | A1* | 3/2018 | Zeifman | G06Q 10/063 |
| 2018/0306476 | A1* | 10/2018 | Brady | F25B 49/005 |
| 2019/0063806 | A1* | 2/2019 | Nakamura | F25B 49/022 |
| 2020/0227159 | A1* | 7/2020 | Boisvert | G16H 40/20 |

FOREIGN PATENT DOCUMENTS

| | | | |
|---|---|---|---|
| CN | 105509266 | A | 4/2016 |
| CN | 106524411 | A | 3/2017 |
| EP | 3396638 | A1 | 10/2018 |
| JP | 4728909 | B2 | 2/2008 |

* cited by examiner

HVAC SYSTEM DISCOMFORT INDEX AND DISPLAY

CROSS-REFERENCE TO RELATED APPLICATIONS

This application claims the benefit of Chinese Patent Application number 201910137094.X filed Feb. 25, 2019, which is incorporated herein by reference in its entirety.

BACKGROUND

Exemplary embodiments pertain to the art of HVAC systems and more specifically to discomfort index and display for HVAC systems.

In heating, ventilation, and air-conditioning (HVAC) systems, customer comfort issues can be caused by a host of issues. Often times, customer comfort issues may be caused by an issue with the HVAC system itself and can be addressed with maintenance or replacement of components within the system. Other times, operations conditions with respect to the HVAC system can be the root cause of customer comfort issues. For example, when the HVAC system is exposed to unusually high load parameters (e.g., windows opened, extremely hot/cold weather), the customer comfort issue may be temporary and not necessarily require maintenance or replacement of the system. Identifying the root cause of customer comfort issues can be a challenge.

BRIEF DESCRIPTION

Disclosed is a system. The system includes a processor coupled to a memory, the processor configured to receive operational data associated with the HVAC system, receive environmental data associated with the HVAC system, analyze the operational data and the environmental data to determine a potential comfort issue with the HVAC system, receive a discomfort index associated with the HVAC system, plot an indicia on the discomfort index based on the operational data and the environmental data, and determine a root cause of the potential comfort issue based at least in part on a coordinate of the indicia on the discomfort index.

In addition to one or more of the features described above, or as an alternative, further embodiments of the system may include that the processor is further configured to perform an action based at least in part on the root cause.

In addition to one or more of the features described above, or as an alternative, further embodiments of the system may include that the action comprises generating an alert for a user of the HVAC system.

In addition to one or more of the features described above, or as an alternative, further embodiments of the system may include that the action comprises scheduling a maintenance operation on the HVAC system.

In addition to one or more of the features described above, or as an alternative, further embodiments of the system may include that the root cause comprises at least one of a known fault for the HVAC system, a capacity issue for the HVAC system, and a load issue for the HVAC system.

In addition to one or more of the features described above, or as an alternative, further embodiments of the system may include that the indicia is plotted based at least in part on a summation indoor air temperature change rate (IATR).

In addition to one or more of the features described above, or as an alternative, further embodiments of the system may include that the environmental data includes outside air temperature data.

In addition to one or more of the features described above, or as an alternative, further embodiments of the system may include that the discomfort index comprises a graph including a y-axis and an x-axis, wherein the y-axis includes a discomfort parameters and the x-axis include outside air temperature.

In addition to one or more of the features described above, or as an alternative, further embodiments of the system may include that the discomfort index further comprises a sloped line separating a first region from a second region in the discomfort index; and wherein the sloped line is determine based at least in part on available capacity for the HVAC system.

In addition to one or more of the features described above, or as an alternative, further embodiments of the system may include that the discomfort index further comprises a first horizontal line separating the first region and the second region from a third region in the discomfort index and wherein the discomfort index further comprises a second horizontal line separating the third region from a fourth region in the discomfort index.

Disclosed is a method for controlling an HVAC system. The method includes receiving, from a sensor, operational data associated with the HVAC system, receiving, from the sensor, environmental data associated with the HVAC system, analyzing the operational data and the environmental data to determine a potential comfort issue with the HVAC system, receiving a discomfort index associated with the HVAC system, plotting an indicia on the discomfort index based on the operational data and the environmental data, and determining a root cause of the potential comfort issue based at least in part on a coordinate of the indicia on the discomfort index.

In addition to one or more of the features described above, or as an alternative, further embodiments of the method may include performing an action based at least in part on the root cause.

In addition to one or more of the features described above, or as an alternative, further embodiments of the method may include that the action comprises generating an alert for a user of the HVAC system.

In addition to one or more of the features described above, or as an alternative, further embodiments of the method may include that the action comprises scheduling a maintenance operation on the HVAC system.

In addition to one or more of the features described above, or as an alternative, further embodiments of the method may include that the root cause comprises at least one of a known fault for the HVAC system, a capacity issue for the HVAC system, and a load issue for the HVAC system.

In addition to one or more of the features described above, or as an alternative, further embodiments of the method may include that the indicia is plotted based at least in part on a summation indoor air temperature change rate (IATR).

In addition to one or more of the features described above, or as an alternative, further embodiments of the method may include that the environmental data includes outside air temperature data.

In addition to one or more of the features described above, or as an alternative, further embodiments of the method may include that the discomfort index comprises a graph including a y-axis and an x-axis, wherein the y-axis includes a discomfort parameters and the x-axis include outside air temperature.

In addition to one or more of the features described above, or as an alternative, further embodiments of the method may include that the discomfort index further comprises a sloped line separating a first region from a second region in the discomfort index; and wherein the sloped line is determine based at least in part on available capacity for the HVAC system.

In addition to one or more of the features described above, or as an alternative, further embodiments of the method may include that the discomfort index further comprises a first horizontal line separating the first region and the second region from a third region in the discomfort index and wherein the discomfort index further comprises a second horizontal line separating the third region from a fourth region in the discomfort index.

BRIEF DESCRIPTION OF THE DRAWINGS

The following descriptions should not be considered limiting in any way. With reference to the accompanying drawings, like elements are numbered alike.

The diagrams depicted herein are illustrative. There can be many variations to the diagram or the operations described therein without departing from the spirit of the disclosure. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

DETAILED DESCRIPTION

Figure 1:
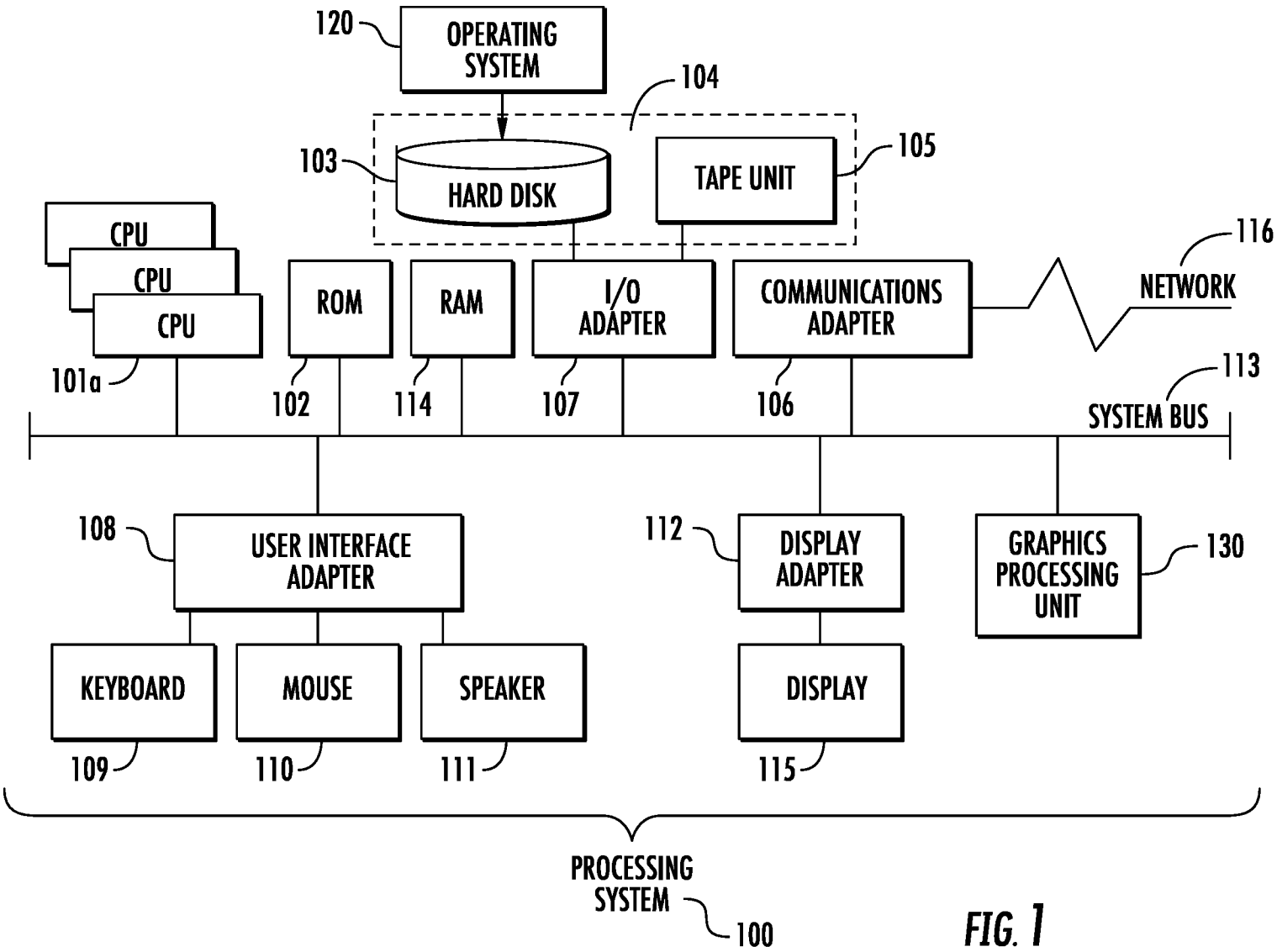
FIG. 1 depicts a block diagram of a computer system for use in implementing one or more embodiments.

Referring to FIG. 1, there is shown an embodiment of a processing system 100 for implementing the teachings herein. In this embodiment, the system 100 has one or more central processing units (processors) 101*a*, 101*b*, 101*c*, etc. (collectively or generically referred to as processor(s) 101). In one embodiment, each processor 101 may include a reduced instruction set computer (RISC) microprocessor. Processors 101 are coupled to system memory 114 and various other components via a system bus 113. Read only memory (ROM) 102 is coupled to the system bus 113 and may include a basic input/output system (BIOS), which controls certain basic functions of system 100.

FIG. 1 further depicts an input/output (I/O) adapter 107 and a network adapter 106 coupled to the system bus 113. I/O adapter 107 may be a small computer system interface (SCSI) adapter that communicates with a hard disk 103 and/or tape storage drive 105 or any other similar component. I/O adapter 107, hard disk 103, and tape storage device 105 are collectively referred to herein as mass storage 104. Operating system 120 for execution on the processing system 100 may be stored in mass storage 104. A network adapter 106 interconnects bus 113 with an outside network 116 enabling data processing system 100 to communicate with other such systems. A screen (e.g., a display monitor) 115 is connected to system bus 113 by display adaptor 112, which may include a graphics adapter to improve the performance of graphics intensive applications and a video controller. In one embodiment, adapters 107, 106, and 112 may be connected to one or more I/O busses that are connected to system bus 113 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 113 via user interface adapter 108 and display adapter 112. A keyboard 109, mouse 110, and speaker 111 all interconnected to bus 113 via user interface adapter 108, which may include, for example, a Super I/O chip integrating multiple device adapters into a single integrated circuit.

In exemplary embodiments, the processing system 100 includes a graphics processing unit 130. Graphics processing unit 130 is a specialized electronic circuit designed to manipulate and alter memory to accelerate the creation of images in a frame buffer intended for output to a display. In general, graphics processing unit 130 is very efficient at manipulating computer graphics and image processing, and has a highly parallel structure that makes it more effective than general-purpose CPUs for algorithms where processing of large blocks of data is done in parallel.

Thus, as configured in FIG. 1, the system 100 includes processing capability in the form of processors 101, storage capability including system memory 114 and mass storage 104, input means such as keyboard 109 and mouse 110, and output capability including speaker 111 and display 115. In one embodiment, a portion of system memory 114 and mass storage 104 collectively store an operating system coordinate the functions of the various components shown in FIG. 1.

Turning now to an overview of technologies that are more specifically relevant to aspects of the disclosure, with the growth of installations of smart wireless thermostats, the collection and analytics of data presents opportunities. With analytics applied to collected data, HVAC systems and the corresponding smart thermostats can now perform system diagnosis on performance and operation. As mentioned above, customer comfort issues can be a quality factor for HVAC system manufacturers. Any prolonged customer comfort issues can cause customers to look unfavorably on the HVAC product. With the collection of operational and environmental data by these smart thermostats, analytics can apply to determine a cause of a customer comfort issue and implement an action or an alert to remedy the customer comfort issue.

Turning now to an overview of the aspects of the disclosure, one or more embodiments of the present disclosure provide a system for an HVAC system discomfort index that crafts an alert based on this index. The alert or action is generated based on discerning between customer comfort issues arising from an HVAC system fault or an HVAC system operational condition that exceeds the capacity of the system.

Figure 2:
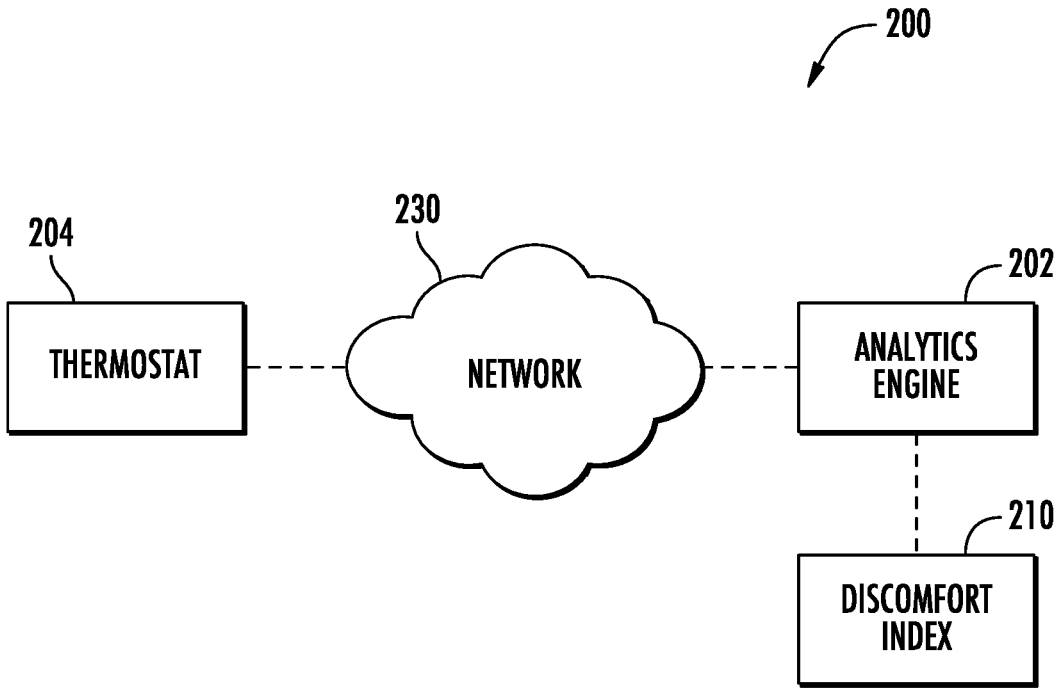
FIG. 2 depicts a system for HVAC system discomfort diagnostic according to embodiments.

Turning now to a more detailed description of aspects of the present disclosure, FIG. 2 depicts a system for HVAC system discomfort diagnostic according to embodiments. The system 200 includes a thermostat 204 that can connected to an analytics engine 202 through network 230. In one or more embodiments, the thermostat 204 operates an HVAC system within a location. The location can be a house, building, or any facility. The thermostat 204 is operable to collect operation data about the HVAC system as well as environmental data associated with the thermostat 204. For example, environmental data can include outside air temperature, inside air temperature, humidity, and the like. In addition, the thermostat 204 can obtain location data, weather data, and the like for the HVAC system through the network 230 connection.

The operational data for the HVAC system and the environmental data can be transmitted to the analytics engine 202 for processing. The analytics engine 202 can be located on a remote server accessed by the thermostat 204. In some embodiments, the analytics engine 202 can be local to the thermostat 204. A discomfort metric (parameter) can be calculated, by the analytics engine 202, based on an amount of discomfort an occupant would experience when the HVAC system is not performing or is operating at a load beyond its capacity. In addition, the analytics engine can determine an associated capacity parameter of the HVAC system utilizing either a system sizing metric or a minimum/maximum outdoor air temperature in which indoor conditions can be maintained. The discomfort of an occupant can be plotted on a discomfort index 210 generated by the analytics engine 202. The discomfort index 210 can be based on the environmental parameters associated with the HVAC system such as outside air temperature, regional temperature averages, and humidity. A discomfort parameter can be determined and plotted on the discomfort index 210 to determine a cause of the discomfort to the occupant.

Figure 3:
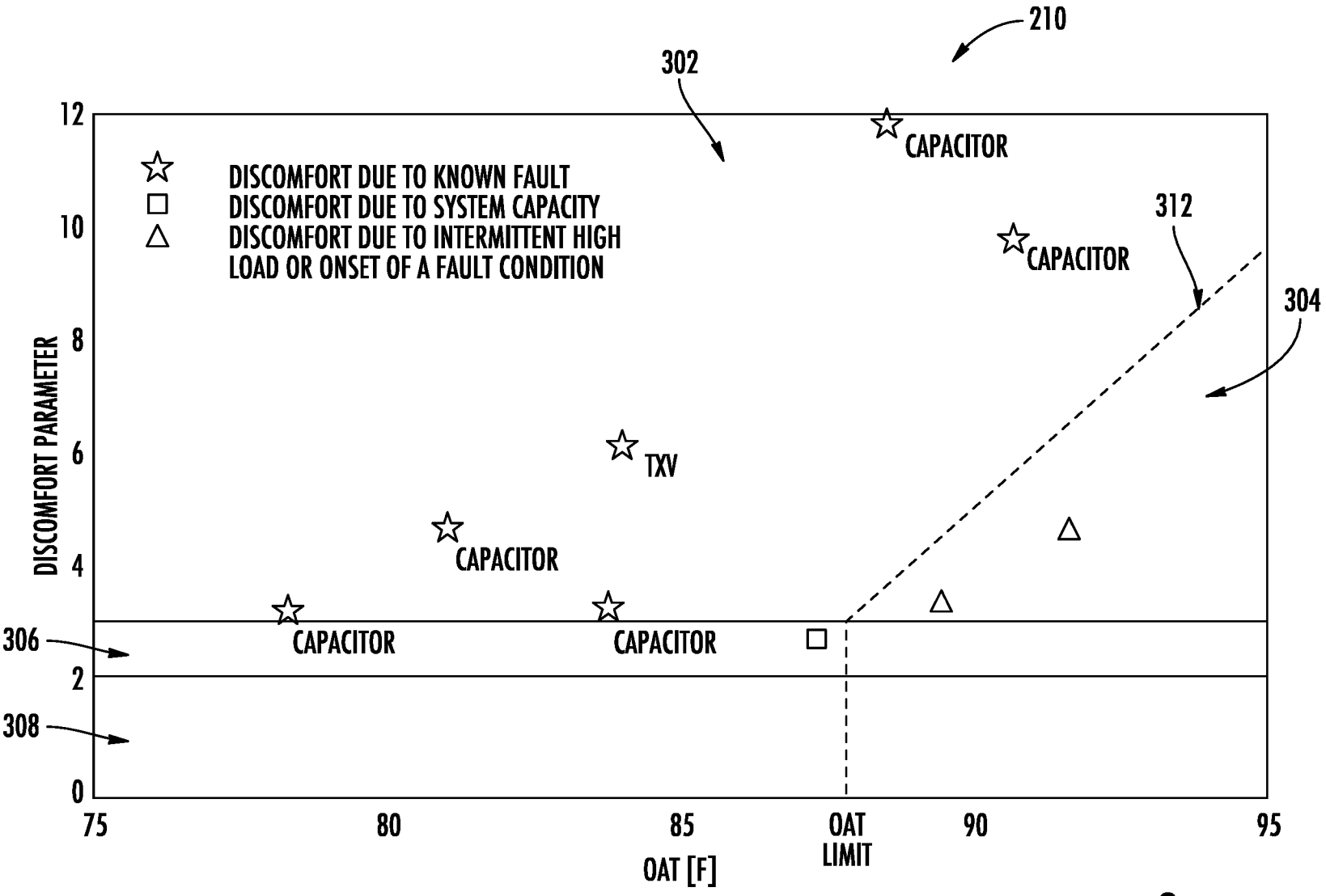
FIG. 3 depicts an exemplary discomfort index 210 according to one or more embodiments.

FIG. 3 depicts an exemplary discomfort index 210 according to one or more embodiments. The x-axis of the discomfort index 210 can be the outside air temperature (OAT) and the y-axis of the discomfort index 210 can be a discomfort parameter. An example of discomfort indices is summation indoor air temperature change rate (Sum IATR) which is an accumulation value of abnormal IATR within a time window. Abnormal IATR means indoor temperature increases when HVAC is operated at cooling mode or indoor air temperature decreases when HVAC is operated at heating mode. The time window could be an hour, a day or any other time duration. The OAT limit is calculated max or min OAT at which indoor air temperature can be well maintained by the HVAC system at cooling or heating mode. The illustrated discomfort index 210 includes four regions 302, 304, 306, 308. The first region 302 includes coordinates that show a root cause of discomfort due to a known fault identified in the HVAC system. The second region 304 includes coordinates that show a root cause of occupant discomfort due to the HVAC system load (e.g., high outside air temperatures, etc.). The first region 302 is separated from the second region 304 by a sloped line 312. This sloped line 312 is determined based on the amount of available capacity for the HVAC system being monitored. The slope of the sloped line 312, in some embodiments, can be determined empirically (i.e., based on plotting of known faulty and known good sites) or by HVAC system modeling. In one or more embodiments, the discomfort index 210 includes a third region 306 and a fourth region 308. While the illustrated example shows the regions corresponding to different values along the x-axis and y-axis, the configuration of the different regions can be adjusted based on operational conditions and environmental conditions, for example. In one or more embodiments, the analytics engine 202 (from FIG. 2) can plot an indicia (e.g., star) in the discomfort index 210 within the different regions based on the discomfort parameter and the outside air temperature. For indicia located in the third region 306, the discomfort of the occupant can be due to intermittent high load for the HVAC system or the onset of a fault condition for the HVAC system. For indicia located in the fourth region 308, the HVAC system is operating with no or minimal discomfort to an occupant.

In one or more embodiments, the analytics engine 202 can determine an action based on the cause of occupant discomfort. For example, an alert can be generated and sent to a maintenance system to indicate that a maintenance operation would need to be performed on the HVAC system. In another example, an alert can be generated to a customer sales representative to notify the customer (occupant) that a different HVAC system would be beneficial based on the conditions of the building (e.g., environmental parameters, etc.).

In one or more embodiments, the thermostat 204 and analytics engine 202 can be implemented on the processing system 100 found in FIG. 1. Additionally, a cloud computing system can be in wired or wireless electronic communication with one or all of the elements of the system 200. Cloud can supplement, support or replace some or all of the functionality of the elements of the system 200. Additionally, some or all of the functionality of the elements of system 200 can be implemented as a node of a cloud. The cloud computing described herein is only one example of a suitable cloud computing environment and is not intended to suggest any limitation as to the scope of use or functionality of embodiments described herein.

Figure 4:
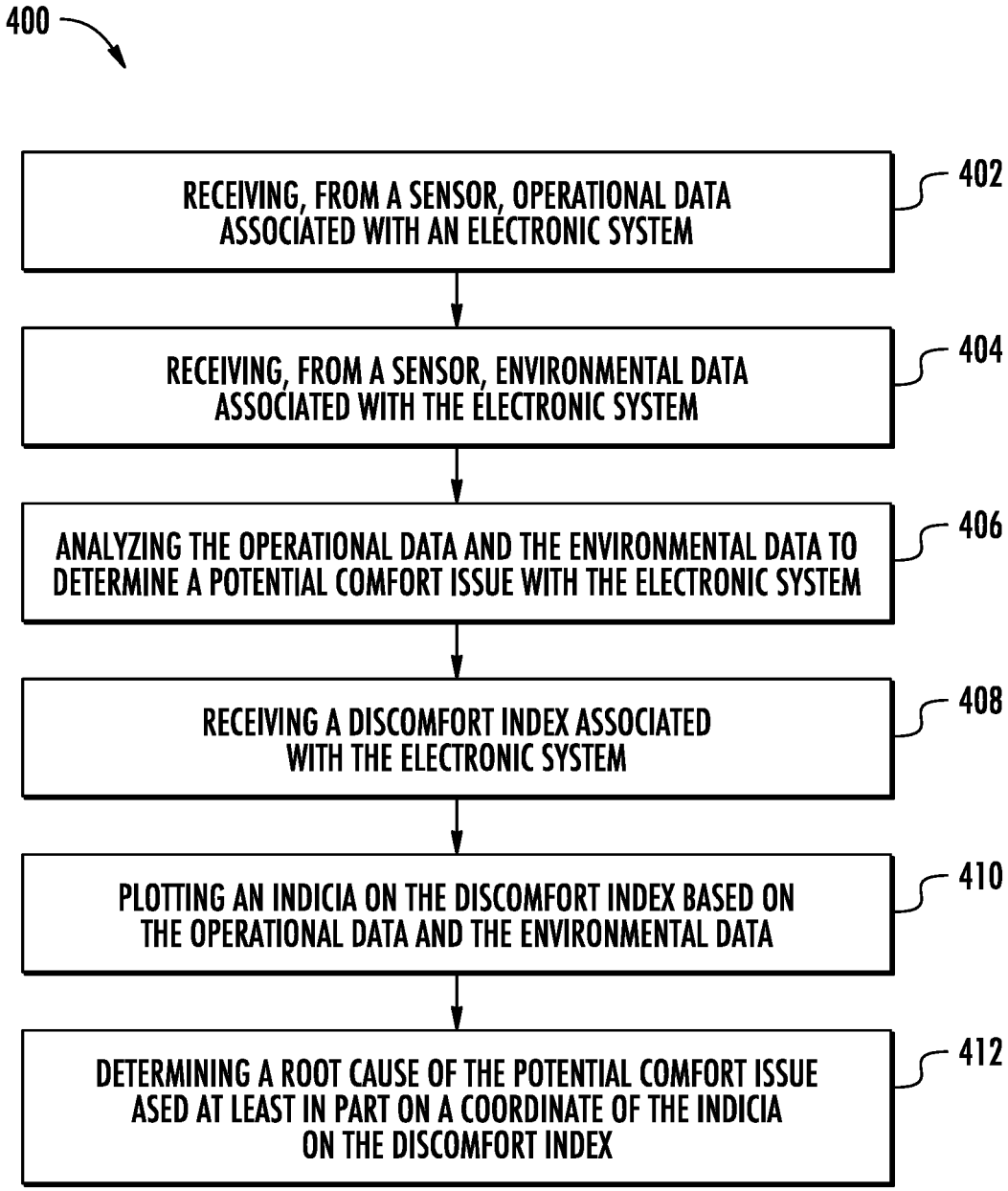
FIG. 4 depicts a flow diagram of a method for determining discomfort with an electronic system according to one or more embodiments.

FIG. 4 depicts a flow diagram of a method for determining discomfort with an electronic system according to one or more embodiments. The method 400 includes receiving, from a sensor, operational data associated with an electronic system, as shown in block 402. At block 404, the method 400 includes receiving, from the sensor, environmental data associated with the electronic system. The system 400, at block 406, also includes analyzing the operational data and the environmental data to determine a potential comfort issue with the electronic system. Also, at block 408, the method 400 includes receiving a discomfort index associated with the electronic system. The method 400 includes plotting an indicia on the discomfort index based on the operational data and the environmental data, as shown at block 410. And at block 412, the method 400 includes determining a root cause of the potential comfort issue based at least in part on a coordinate of the indicia on the discomfort index.

Additional processes may also be included. It should be understood that the processes depicted in FIG. 4 represent illustrations and that other processes may be added or existing processes may be removed, modified, or rearranged without departing from the scope and spirit of the present disclosure.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A computer-implemented method for analyzing operations of a heating, ventilation, and air-conditioning (HVAC) system used to control a temperature of an indoor space, the computer-implemented method comprising:

implementing, using an analytics engine, a model of the HVAC system to perform discomfort-related operations comprising making a determination, based at least in part on operational data associated with the HVAC system and environmental data associated with the HVAC system, of causal relationships between discomfort parameters, outside air temperature parameters, and a discomfort source;

using the analytics engine and the model of the HVAC system to perform a classification operation comprising determining, based at least in part on a discomfort metric and the causal relationships, whether a source of the level of discomfort comprises a presence of a fault in the HVAC system or a load placed on the HVAC system; and generating an alert responsive to determining that the source of the level of discomfort comprises the fault in the HVAC system, wherein the alert prompts a user of the HVAC system to take an action toward evaluating a need to repair HVAC system;

wherein the discomfort metric represents a level of discomfort experienced by an occupant of the indoor space.

2. The computer-implemented method of claim 1, wherein the classification operation further comprises determining, based at least in part on the discomfort metric and the relationships, whether the discomfort metric is below a threshold for concluding that the occupant of the indoor space is experiencing discomfort.

3. The computer-implemented method of claim 1, wherein the classification operation further comprises using the model of the HVAC system to determine, based at least in part on the discomfort metric and the relationships, whether the source of the level of discomfort comprises the presence of a fault in the HVAC system or the load placed on the HVAC system.

4. The computer-implemented method of claim 1, wherein:

the discomfort-related operations comprise representing the relationships in a discomfort index; and the classification operation further comprises using the discomfort index to determine, based at least in part on the discomfort metric, whether the source of the level of discomfort comprises the presence of a fault in the HVAC system or the load on the HVAC system.

5. The computer-implemented method of claim 4, wherein the discomfort metric is based at least in part on a summation indoor air temperature change rate (IATR).

6. The computer-implemented method of claim 4, wherein the discomfort metric is based at least in part on outside air temperature data.

7. The computer-implemented method of claim 4, wherein:

the discomfort index comprises a graph including a y-axis and an x-axis; and the y-axis includes a set of discomfort parameters and the x-axis includes a set of outside air temperatures.

8. The computer-implemented method of claim 7, wherein:

the discomfort index further comprises a sloped line separating a first region from a second region in the discomfort index; and the sloped line is determined based at least in part on available capacity for the HVAC system using the model of the HVAC system.

9. The computer-implemented method of claim 8, wherein:

the discomfort index further comprises a first horizontal line separating the first region and the second region from a third region in the discomfort index; and the discomfort index further comprises a second horizontal line separating the third region from a fourth region in the discomfort index.

10. The computer-implemented method of claim 1, wherein the classification operation further comprises determining, based at least in part on the discomfort metric and the relationships, whether the source of the level of discomfort comprises at least one of the presence of a fault in the HVAC system, the load on the HVAC system, and a capacity issue of the HVAC system.

11. A system comprising a processor and a computer readable storage medium having program instructions embodied therewith, wherein the computer readable storage medium is not a transitory signal per se, the program instructions readable by the processor system for analyzing operations of an HVAC system used to control a temperature of an indoor space, the system further comprising:

an analytics engine coupled to a memory, the analytics engine operable to implement a model of the HVAC system, the analytics engine and the model of the HVAC system operable to:

perform discomfort-related operations comprising making a determination, based at least in part on operational data associated with the HVAC system and environmental data associated with the HVAC system, of relationships between discomfort parameters, outside air temperature parameters, and a discomfort source;

a classification operation comprising determining, based at least in part on a discomfort metric and the relationships, whether a source of the level of discomfort comprises the presence of a fault in the HVAC system or a load on the HVAC system; and generate an alert responsive to determining that the source of the level of discomfort comprises the fault in the HVAC system, wherein the alert prompts a user of the HVAC system to take an action toward evaluating a need to repair HVAC system;

wherein the discomfort metric represents a level of discomfort experienced by an occupant of the indoor space.

12. The system of claim 11, wherein the classification operation further comprises, determining, based at least in part on the discomfort metric and the relationships, whether the discomfort metric is below a threshold for concluding that the occupant of the indoor space is experiencing discomfort.

13. The system of claim 11, wherein the classification operation further comprises using the model of the HVAC system to determine, based at least in part on the discomfort metric and the relationships, whether the source of the level of discomfort comprises the presence of a fault in the HVAC system or the load on the HVAC system.

14. The system of claim 11, wherein:

the discomfort-related operations comprise representing the relationships in a discomfort index; and the classification operation further comprises using the discomfort index to determine, based at least in part on the discomfort metric, whether the source of the level of discomfort comprises the presence of a fault in the HVAC system or a load on the HVAC system.

15. The method of claim 14, wherein the discomfort metric is based at least in part on a summation indoor air temperature change rate (IATR).

16. The system of claim 14, wherein the discomfort metric is based at least in part on outside air temperature data.

17. The system of claim 14, wherein:

the discomfort index comprises a graph including a y-axis and an x-axis; and the y-axis includes a set of discomfort parameters and the x-axis include a set of outside air temperatures.

18. The system of claim 17, wherein:

the discomfort index further comprises a sloped line separating a first region from a second region in the discomfort index; and the sloped line is determined based at least in part on available capacity for the HVAC system using the model of the HVAC system.

19. The system of claim 18, wherein:

the discomfort index further comprises a first horizontal line separating the first region and the second region from a third region in the discomfort index; and the discomfort index further comprises a second horizontal line separating the third region from a fourth region in the discomfort index.

20. The system of claim 11, wherein the classification operation further comprises determining, based at least in part on the discomfort metric and the relationships, whether the source of the level of discomfort comprises at least one of the presence of a fault in the HVAC system, the load on the HVAC system, and a capacity issue of the HVAC system.

* * * * *